US010392758B2

(12) United States Patent
Austin

(10) Patent No.: US 10,392,758 B2
(45) Date of Patent: Aug. 27, 2019

(54) BRIDGE TIE FASTENER SYSTEM

(71) Applicant: Lewis Bolt & Nut Company, Wayzata, MN (US)

(72) Inventor: Timothy John Austin, Rocky Ford, CO (US)

(73) Assignee: Lewis Bolt & Nut Company, Wayzata, MN (US)

( * ) Notice: Subject to any disclaimer, the term of this patent is extended or adjusted under 35 U.S.C. 154(b) by 240 days.

(21) Appl. No.: 15/627,712

(22) Filed: Jun. 20, 2017

(65) Prior Publication Data

US 2017/0362785 A1 Dec. 21, 2017

Related U.S. Application Data

(60) Provisional application No. 62/352,782, filed on Jun. 21, 2016.

(51) Int. Cl.
*E01D 19/12* (2006.01)

(52) U.S. Cl.
CPC ..... *E01D 19/12* (2013.01)

(58) Field of Classification Search
CPC ..... E01B 9/00; E01B 9/64; E01B 9/48; E01B 9/483; E01B 9/486; E01B 13/00; E01B 13/02; E01D 19/12; Y10T 29/49948
See application file for complete search history.

(56) References Cited

U.S. PATENT DOCUMENTS

| | | | | |
|---|---|---|---|---|
| 4,832,261 | A * | 5/1989 | Fee | E01B 9/486 238/331 |
| 8,366,015 | B2 | 2/2013 | Van Belkom | |
| 9,428,867 | B2 | 8/2016 | Harman | |
| 9,512,573 | B2 * | 12/2016 | Austin | E01D 19/12 |
| 9,714,486 | B2 | 7/2017 | Van Belkom | |

(Continued)

FOREIGN PATENT DOCUMENTS

| | | |
|---|---|---|
| JP | 3207634 | 11/2016 |
| WO | WO 2008/048095 | 4/2008 |

(Continued)

OTHER PUBLICATIONS

U.S. Appl. No. 14/465,397, filed Aug. 21, 2014, Austin et al.

*Primary Examiner* — Robert J McCarry, Jr.
(74) *Attorney, Agent, or Firm* — Fish & Richardson P.C.

(57) ABSTRACT

Methods, system and apparatus are disclosed, including a tie fastener apparatus for attaching railroad ties to a superstructure. The apparatus comprises a threaded hook bolt, including a hook to engage the underside of a flange of a beam. The apparatus further comprises a cross strap configured to engage with a flange of the beam. The apparatus further comprises a metal member for engaging plural ties. The metal member includes a tie fastener hole at plural locations. A nut fastens a threaded end of the threaded hook bolt for installation when the threaded hook bolt is passed through the bolt hole. When the threaded hook bolt is installed, the hook engages the superstructure, and a neck of the threaded hook bolt engages the cross strap. The apparatus is installed from above the superstructure without drilling holes in ties or the superstructure, or requiring manned installation from below the superstructure.

22 Claims, 9 Drawing Sheets

(56) References Cited

U.S. PATENT DOCUMENTS

| | | | | |
|---|---|---|---|---|
| 2010/0019056 | A1* | 1/2010 | Reed | E01B 13/02 238/310 |
| 2011/0006126 | A1* | 1/2011 | Henderson | E01B 13/02 238/327 R |
| 2011/0155819 | A1 | 6/2011 | Ryu | |
| 2014/0251175 | A1 | 9/2014 | Harman | |
| 2015/0337499 | A1* | 11/2015 | Sackler | E01B 7/22 238/310 |
| 2016/0289900 | A1 | 10/2016 | Harman | |

FOREIGN PATENT DOCUMENTS

| | | |
|---|---|---|
| WO | WO 2010/035958 | 4/2010 |
| WO | WO 2015/002531 | 1/2015 |

* cited by examiner

BRIDGE TIE FASTENER SYSTEM

CROSS-REFERENCE TO RELATED APPLICATION

This application claims priority to U.S. Provisional Application No. 62/352,782, filed on Jun. 21, 2016. The disclosure of the prior application is considered part of and is incorporated by reference in the disclosure of this application.

FIELD OF INVENTION

The invention relates to an improved system for securing railroad bridge open tie decks to bridge superstructures.

BACKGROUND

Bridges are an integral part of railroad infrastructure. Bridges consist of a substructure, a superstructure, and a deck. A common deck type is an open tie deck, which consists of evenly-spaced wooden bridge ties laid transverse to the superstructure and rails. One conventional way of securing the open tie deck to steel superstructure involves drilling a hole through the bridge tie and manually feeding an L-bolt through the hole from below. The bottom leg of the L-bolt engages the bottom side of the top flange of the steel beam or girder superstructure, thus providing vertical and lateral deck securement. The installation process typically requires a railroad construction worker to scale or be suspended from the underside of the bridge or to lay on top of the deck and reach down through to ensure that the L-bolt is properly positioned to make a good connection to the beam or girder flange. The vertical leg of the L-bolt is threaded on the top portion to accept a washer and nut to secure the bolt in place from the top of the bridge tie. Disadvantages of such conventional systems include ergonomic positions needed for installation and the requirement that holes be drilled in ties. These holes must be drilled near to the flange to ensure proper engagement of the L-bolt to the flange. This is very difficult to do consistently, thus sacrificing the grip of the L-bolt, while in addition setting the L-bolt up for overloading since it's not fully engaging the flange. In addition, these holes provide an access point for moisture and wood-destroying organisms to the heart of the tie, often to portions that were not able to be treated with wood preservatives, and therefore can result in accelerated rot and decomposition. The holes also require time for drilling and manual threading of the L-bolt through the holes. Further, conventional systems also require the use of a timber outer guardrail, which also requires that additional holes be drilled to secure the timber outer guardrail.

SUMMARY OF THE INVENTION

In one aspect, the invention relates to an improved bridge tie fastener system for securing open deck ties (e.g., bridge ties) to a member, such as a steel superstructure. Specifically, the bridge tie fastener system provides vertical, lateral, and longitudinal restraint of open deck bridge ties and thus rails connected to the bridge ties.

Key elements of the bridge tie fastener system include at least a cross strap, a hook bolt, and a tie bracket. The cross strap can be used in locations in which relative positions of a rail and the underlying steel superstructure does not allow configurations of two-part systems that use only hook bolts and tie brackets. For example, one such two-part system is the "Bridge Tie Fastener System" (U.S. patent application Ser. No. 14/465,397), filed on Aug. 21, 2014, which is hereby included by reference in its entirety. The three-part system described in this current disclosure is similar to the two-part system, with the addition of a cross strap and various other changes (including the hook bolt). For example, the cross strap can rest across the top flange of the beam. One end of the cross strap can include a hook that engages the top flange of the beam. The other end of the cross strap can include at least one L-shaped slot for engaging a hook end of the hook bolt that also engages the top flange of the beam on that end of the cross strap. In some implementations, two L-shaped slots can be included on the cross strap to accommodate two different beam flange widths (e.g., 10" and 12"). The slots each have a sloped recess that matches the angle that the hook bolts makes with the bracket. The slots are arranged such that the hook bolt can pass into the slot when oriented vertically, but the hook bolt is held securely in place when placed at the installed angle. The hook bolt in this system makes an angle greater than 90°. The hook bolt has a protrusion on one side of the hook for engaging the cross strap. The three-part system described herein is an extension of the two-part system (U.S. patent application Ser. No. 14/465,397), e.g., for use in special locations where the relative positions of the rail and the underlying steel bridge structure do not allow the two-part system to be used. This can occur in cases where the steel bridge structure is narrow and nearly directly underneath the rails. The three-part system provides the application of a downward force to hold the timbers down to the bridge beams. The cross strap transfers the horizontal component of the force across to the opposite edge of the beam.

The end of the hook bolt is bent at an angle relative to the shank of the hook. This allows the hook bolt to pass through an opening in the cross strap and to engage the flange (while also engaging the cross strap). The other end of the hook bolt is threaded to accept a nut, for passing through and connecting to the tie bracket. Other components can be added to the system. The tie bracket is fastened to two adjacent bridge ties with nails or other fasteners such as lag screws. An optional protrusion from the bottom of the tie bracket can hang below top surfaces of adjacent ties. The protrusion fits between (and enforces the spacing between) adjacent ties. The tie bracket effectively locks adjacent ties together, providing increased strength and resistance to longitudinal deck movement.

Key elements of the bridge tie fastener system also include a hook bolt that is installed to rest at an angle from vertical (e.g., less than 90 degrees), such as substantially equal to 70 degrees. Other angles are possible. The hook bolt takes the lateral load, e.g., preventing the bridge tie from moving side to side along its length. This is enabled in part by the installation of a tie bracket and hook bolt on the other end of the bridge tie. The hook bolt mounts to the tie bracket in a provided bolt hole between the ties and therefore does not require a hole to be drilled through the tie.

Advantages of the system include improved installation ergonomics, logistics, and speed as well as reduced need to modify bridge ties which will improve material service life. Additionally timber outer guardrail usage may be reduced or eliminated. The bridge tie fastener system can be inspected from above the bridge. The performance of the bridge tie fastener system does not substantially degrade with degradation of the tie, as opposed to a conventional hook bolt that relies on the tie securely holding the hook bolt for a significant amount of its performance.

In general, another innovative aspect of the subject matter described in this specification can be implemented in a tie fastener apparatus for attaching railroad ties to a superstructure. The apparatus comprises a cross strap for engaging a top side of a flange of a beam of the superstructure. The apparatus comprises a threaded hook bolt, including a hook on one end of the threaded hook bolt, the hook including a hook end configured to engage both the underside of the flange of the beam of the superstructure and the cross strap. The apparatus further comprises a metal member for engaging two or more ties, the metal member including a tie fastener hole at one or more locations. The apparatus further comprises a nut configured to be fastened to a threaded end of the threaded hook bolt for installation when the threaded hook bolt is passed through the bolt hole and optionally through a washer. When the threaded hook bolt is installed, including passing a threaded end of the threaded hook bolt through the bolt hole and fastening with the nut, the hook engages the cross strap and superstructure. The tie fastener apparatus is configured to be installed from above the superstructure without drilling holes in the ties or the superstructure and without requiring manned installation from below the superstructure.

These and other implementations can each optionally include one or more of the following features. The metal member can be a tie bracket including: a center section, including the tie fastener hole for receiving the threaded hook bolt, the center section operable to engage with the threaded hook bolt for fastening to the superstructure, and two bracket ends connected to the center section, each bracket end for engaging with respective ones of adjacent ties. Bottom sides of the bracket ends can be configured, when installed, to engage with upper edges of the respective ones of adjacent ties. The metal member can be an L-shaped structural steel bar having plural bolt holes, each respective bolt hole for receiving a respective threaded hook bolt, each respective threaded hook bolt for engaging with the superstructure. The tie fastener apparatus can further include an angled washer operable for installation on a respective threaded hook bolt between the nut and the L-shaped structural steel bar. An angle of the angled washer is operable to accept a perpendicular installation of the threaded end of the respective threaded hook bolt. The shape and size of the angled washer are operable to stay in position during installation. The hook end of the hook bolt can include a substantially flat surface having a length of approximately 2 inches and configured to engage the flange. The threaded hook bolt can include threads having thread specifications of ¾ inch and 10 UNC, and the threads can be configured to accept a nut of the same thread specifications. The shank can have an extended length, enabling installation of the hook to the flange when the threaded hook bolt is pre-positioned through the bolt hole and when the nut and the washer are pre-assembled to the threaded end of the threaded hook bolt. Each bracket end of the tie bracket can include a boss with a tie fastener hole that is vertical or at an angle relative to the tie bracket and is operable to accept a nail, a lag screw, or another fastener to secure the bracket end to a respective tie. Each bracket end of the tie bracket can include, along the bottom of the tie bracket, grooves configured to grip an upper edge of a respective tie and resist movement of the tie bracket relative to the respective tie. The center section of the tie bracket can include a flat upper surface, wherein, when the threaded hook bolt is installed in the tie bracket, the flat upper surface is substantially perpendicular to the shank at the threaded end of the threaded hook bolt, and wherein the flat upper surface is configured to engage the nut and, optionally, the washer. The center section of the tie bracket can include a protrusion that extends below bottom surfaces of the bracket ends of the tie bracket and below the top surfaces of adjacent ties, the protrusion configured to position the tie bracket between, and for the protrusion to substantially fill a space between, adjacent ties. The bracket ends of the tie bracket can include side walls extending upward from substantially flat portions of the bracket ends, the side walls providing increased strength of the bracket ends. The superstructure can be a steel superstructure of a bridge. The metal member can be a reinforced L-shaped structural steel bar. The reinforced L-shaped structural steel bar can include plural bolt holes, each respective bolt hole for receiving a respective threaded hook bolt for engaging with the superstructure, each threaded hook bolt engaged with the reinforced L-shaped structural steel bar using a nut and optionally a washer. The reinforced L-shaped structural steel bar can further include plural tie fastener holes, each respective tie fastener hole for accepting a fastener for fastening to a respective tie, each tie fastener hole operable to accept a nail, a lag screw, or another fastener to secure the reinforced L-shaped structural steel bar to a respective tie. The tie fastener apparatus can further include a boss at each of the plural bolt holes, the top surface of the boss angled relative to the respective bolt hole so that the threaded end of the threaded hook bolt is perpendicular to the top surface of the boss. The tie fastener apparatus can further include a tab end and a tab-ready end, the tab end configured to fit into the tab-ready end during installation. The tie fastener apparatus can further include stabilizers that connect, and provide structural stabilizing strength to, a bottom portion of the reinforced L-shaped structural steel bar and a side of the reinforced L-shaped structural steel bar.

In general, another innovative aspect of the subject matter described in this specification can be implemented in methods that include a computer-implemented method for attaching plural ties to a superstructure. The method includes attaching plural ties to a superstructure. The method includes installing a metal member on two or more ties. The metal member contacts the two or more ties and includes a tie fastener hole at one or more locations on the metal member and a bolt hole at one or more locations on the metal member, the bolt hole for accepting a threaded hook bolt. The method further includes installing a cross strap on top of a flange of a beam of the superstructure. The method further includes, for each bolt hole, installing the threaded hook bolt. Installing the threaded hook bolt includes installing, at a hook end of the threaded hook bolt, a hook of the threaded hook bolt to an underside of the flange of a beam of the superstructure, the hook engaging the underside of the flange, the threaded hook bolt passing through an L-shaped slot in the cross strap, and a neck of the threaded hook bolt engaging the cross strap. Installing the threaded hook bolt further includes passing a threaded end of the threaded hook bolt through the bolt hole and optionally through a washer. Installing the threaded hook bolt further includes fastening and tightening a nut onto the threaded end of the threaded hook bolt, including causing a tightening of the hook to the underside of the flange. The method further includes, for each tie fastener hole, installing a fastener, including using a nail or a lag screw in the respective tie fastener hole to secure the metal member to the tie. Attaching the plural ties to the superstructure occurs from above the superstructure without drilling holes in the ties or the superstructure and without requiring manned installation from below the superstructure.

These and other implementations can each optionally include one or more of the following features. The metal member can be a tie bracket. The tie bracket includes a center section, including the tie fastener hole for receiving the threaded hook bolt. The center section operable to engage with the threaded hook bolt for fastening to the superstructure. The tie bracket further includes two bracket ends connected to the center section, each bracket end for engaging with respective ones of adjacent ties. Bottom sides of the bracket ends are configured, when installed, to engage with upper edges of the respective ones of adjacent ties. The metal member can be an L-shaped structural steel bar having plural bolt holes, each respective bolt hole for receiving a respective threaded hook bolt, each respective threaded hook bolt for engaging with the superstructure. The method can further include installing an angled washer at each of the plural bolt holes. The angled washer can be installed on a respective threaded hook bolt between the nut and the L-shaped structural steel bar. An angle of the angled washer is operable to accept a perpendicular installation of the threaded end of the respective threaded hook bolt. The shape and size of the angled washer are operable to stay in position during installation. The hook end can include a substantially flat surface having a length of approximately 2 inches and configured to engage the flange. The threaded hook bolt can include threads having thread specifications of ¾ inch and 10 UNC, wherein the threads are configured to accept a nut of the same thread specifications. The shank can have an extended length, enabling installation of the hook to the flange when the threaded hook bolt is pre-positioned through the bolt hole and when the nut and the washer are pre-assembled to the threaded end of the threaded hook bolt. Each bracket end of the tie bracket can include a boss with a tie fastener hole that is vertical or at an angle relative to the tie bracket and is operable to accept a nail, a lag screw, or another fastener to secure the bracket end to a respective tie. Each bracket end of the tie bracket can include, along the bottom of the tie bracket, grooves configured to grip an upper edge of a respective tie and resist movement of the tie bracket relative to the respective tie. The center section of the tie bracket can include a flat upper surface, wherein, when the threaded hook bolt is installed in the tie bracket, the flat upper surface is substantially perpendicular to the shank at the threaded end of the threaded hook bolt, and wherein the flat upper surface is configured to engage the nut and, optionally, the washer. The center section of the tie bracket can include a protrusion that extends below bottom surfaces of the bracket ends of the tie bracket and below the top surfaces of adjacent ties, and is configured to position the tie bracket between, and for the protrusion to substantially fill a space between, adjacent ties. The bracket ends of the tie bracket can include side walls extending upward from substantially flat portions of the bracket ends, the side walls providing increased strength of the bracket ends. The superstructure can be a steel superstructure of a bridge. The metal member can be a reinforced L-shaped structural steel bar comprising: plural bolt holes, each respective bolt hole for receiving a respective threaded hook bolt for engaging with the superstructure, each threaded hook bolt engaged with the reinforced L-shaped structural steel bar using a nut and optionally a washer; and plural tie fastener holes, each respective tie fastener hole for accepting a fastener for fastening to a respective tie, each tie fastener hole operable to accept a nail, a lag screw, or another fastener to secure the reinforced L-shaped structural steel bar to a respective tie. The reinforced L-shaped structural steel bar can further include a boss at each of the plural bolt holes, the top surface of the boss angled relative to the respective bolt hole so that the threaded end of the threaded hook bolt is perpendicular to the top surface of the boss. The reinforced L-shaped structural steel bar can further include a tab end and a tab-ready end, the tab end configured to fit into the tab-ready end during installation. The reinforced L-shaped structural steel bar can further include plural stabilizers that connect, and provide structural stabilizing strength to, a bottom portion of the reinforced L-shaped structural steel bar and a side of the reinforced L-shaped structural steel bar.

DESCRIPTION

Figure 1A:
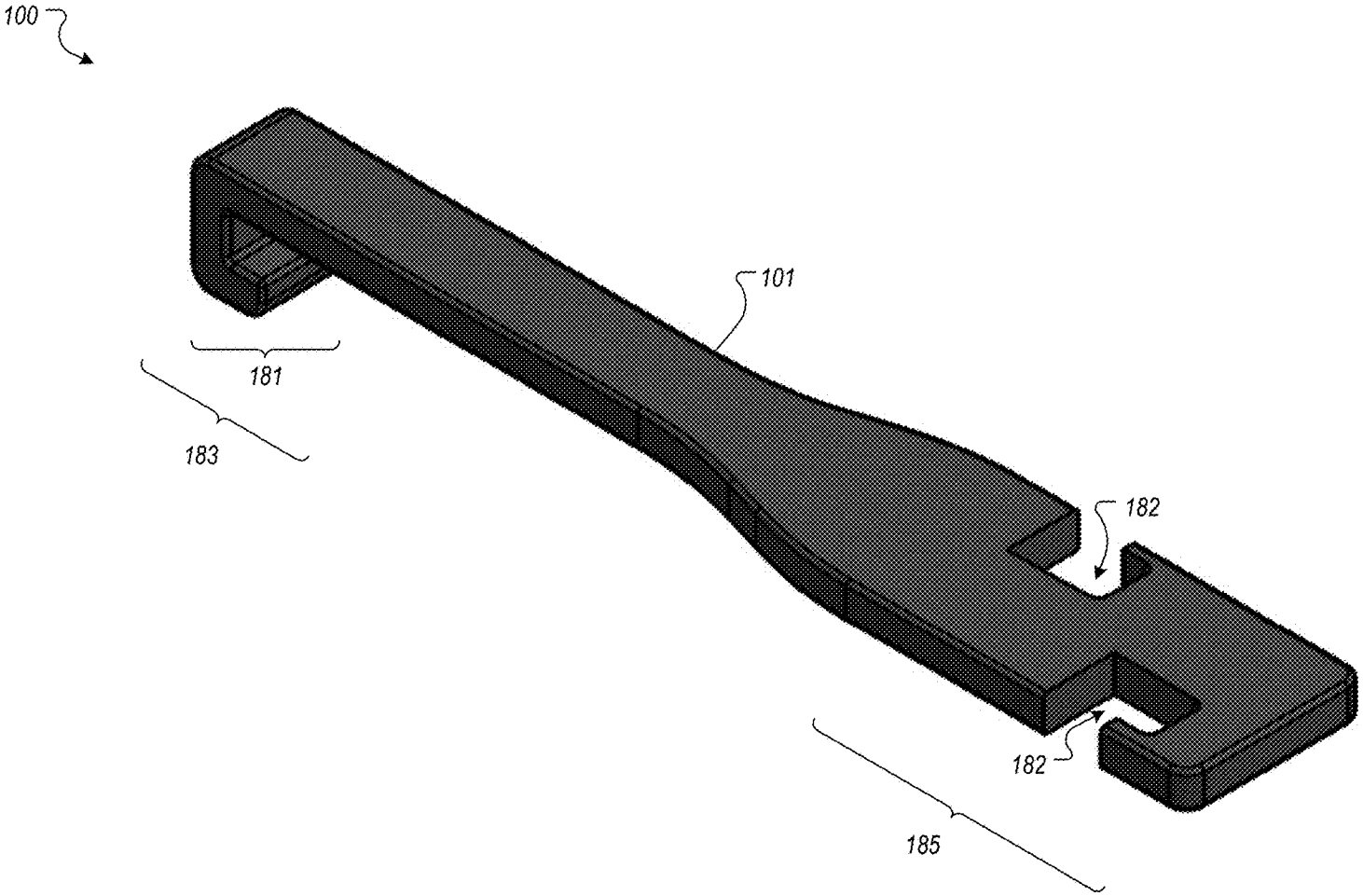
FIGS. 1A-1C are perspective views of a cross strap, a hook bolt, and a tie bracket, respectively.
Figure 1B:
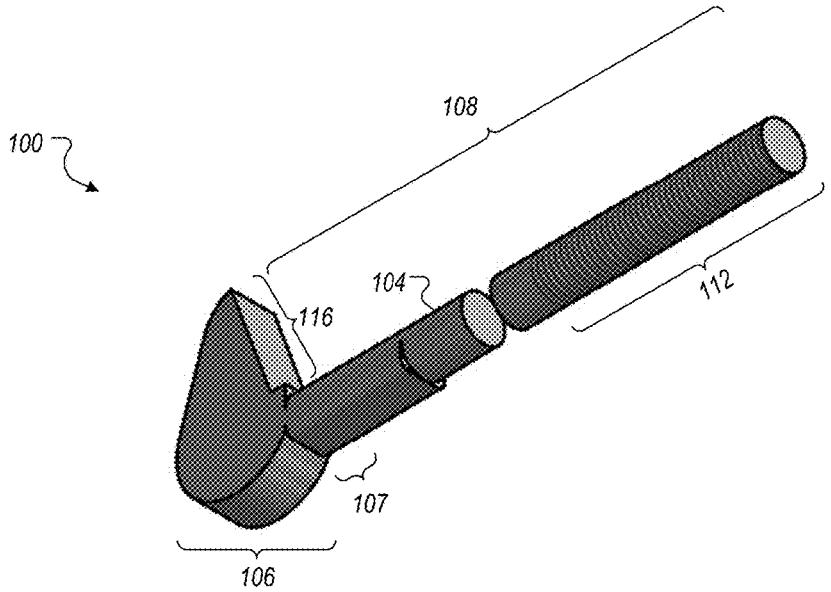
Figure 1C:
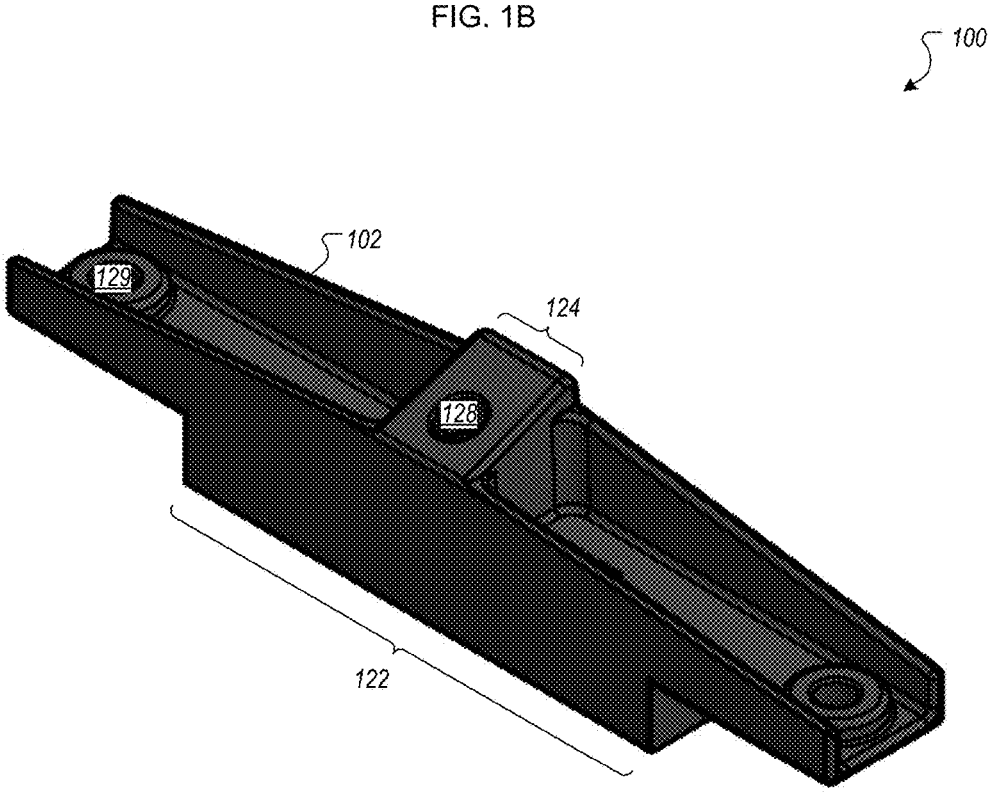

FIGS. 1A-1C depict an improved bridge tie fastener system (or "system") 100 and apparatus for anchoring bridge ties to a bridge decking. The system 100 is also a bridge tie retention system because of the advantages that the system 100 provides. In some implementations, the system 100 consists of three primary parts: a cross strap 101, a tie bracket 102, and a hook bolt 104. Specifically, FIGS. 1A-1C are perspective views of the cross strap 101, the tie bracket 102, and the hook bolt 104. The tie bracket 102, for example, can serve as a metal member (included in the system 100) for engaging two or more ties, the metal member including a tie fastener hole at one or more locations. The cross strap 101, at one of its ends, can engage with (e.g., by hooking over the edge of) a bridge structure, such as a top flange of a beam. The other end of the cross strap 101 can also engage with another end of the top flange, but in concert with the hook bolt 104 (that also engages with the flange) that passes through a slot in the cross strap 101.

For example, a hook end 183 of the cross strap 101 can include a hook 181 that engages the top flange of the beam. The other end (e.g., a slot end 185) of the cross strap 101 can include at least one slot 182 that facilitates receiving the hook bolt 104 and positioning a hook end of the hook bolt 104 with the top flange of the beam. The hook bolt 104 includes a neck 107 adjacent to the shank of the hook bolt 104 for engaging the cross strap 101 with the flange. The hook bolt 104 can be installed at an angle 326 exceeding 90 degrees (e.g., 110 degrees, See FIG. 3C) relative to the top edge of the cross strap 101. In this position, the hook bolt 104 can pull the hook 181 tight against the flange, and the hook bolt 104 can pass through the slot 182 to engage with the cross strap 101, while pressing the cross strap 101 substantially flat against the flange.

The hook bolt 104 has a protrusion (or "hook") 106 on one side of the hook bolt 104 to engage the underside of a flange (e.g., underside of horizontal top portion) of a beam (not shown). The other end of the shank 108 is a threaded end 112 to accept a nut (not shown). In some embodiments, the threads of the threaded end 112 are ¾ inch, 10 UNC, e.g., to accept a nut of the same specifications. Other sizes and specifications can be used. In some embodiments, a length of the shank 108 is sufficiently long as needed so that the hook bolt 104 can pass through the cross strap 101, reach above a bridge tie, be inserted through the tie bracket 102, and accept the nut. In some embodiments, the length of the shank 108 can be sufficiently longer to allow the system 100 to be pre-assembled such that the hook bolt 104 is already inserted through the tie bracket 102 and the nut is already attached to the hook bolt 104. The hook 106 can have a hook end 116, e.g., of approximately two inches or a sufficient length to engage the flange of the beam.

The cross strap 101 and the tie bracket 102 can each be a formed piece (e.g., cast of steel or other suitable material). For example, the cross strap 101 and the tie bracket 102 can each be made of ductile iron, ASTM A524 GRADE 60/40/18 or equivalent. For ease of casting, corners of the cross strap 101 and the tie bracket 102 can each have a radius of 1/16 to ¼ inch, and can include taper surfaces.

The tie bracket 102 optionally includes a protrusion 122 in the center (of the tie bracket 102) that extends below the top of the tie bracket 102 to fill the space between adjacent bridge ties. In some embodiments, the protrusion 122 may be eliminated from the tie bracket 102. The tie bracket 102 has a raised section 124 in the center with a flat upper surface 126 at an angle perpendicular to the angle of the hook bolt 104. A bolt hole 128 is placed in the center of the flat upper surface 126 at the same angle to allow the hook bolt 104 to pass through. Both ends of the tie bracket 102 have a boss 129 with a tie fastener hole that is vertical or at an angle that is operable to accept a nail, a lag screw, or another fastener to secure the tie bracket 102 to the bridge ties. Grooves 130 along the bottom of the tie bracket 102 provide edges to grip an upper surface of a bridge tie and resist movement of the tie bracket 102 relative to the bridge tie.

The tie bracket 102 is positioned on the top of the bridge ties with the hook bolt 104 extending through the bolt hole 128. The hook bolt 104 extends between the bridge ties and hooks onto the beam flange while simultaneously passing through the slot 182 and securing the cross strap 101 to the flange. The tie bracket 102 is secured to the ties with nails, lag screws, or other fasteners in the tie fastener holes provided, and a nut is tightened on the top of the tie bracket 102. This secures the bridge ties to the beam vertically and laterally.

Figure 2A:
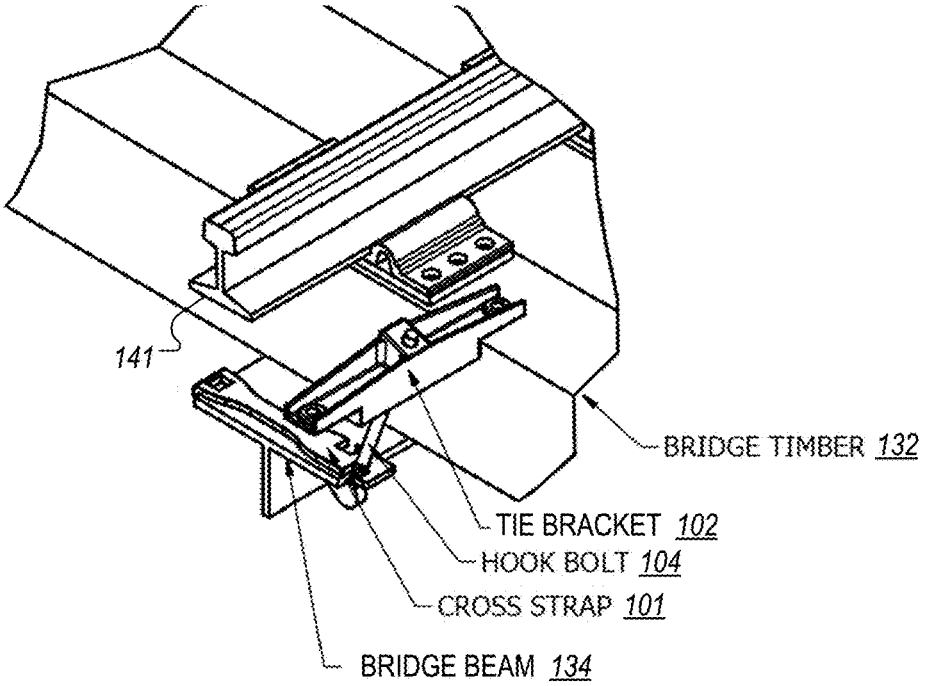
FIG. 2A shows an example installation configuration of the components of the system.

FIG. 2A shows an example installation configuration of the components of the system 100. For example, the tie bracket 102 is attached to a bridge timber 132. A hook bolt 104, engaged with the tie bracket 102, passes through the cross strap 101 and engages with the bridge beam 134 and the cross strap 101. FIG. 2A shows an expanded view of a portion A of FIG. 2B.

Figure 2B:
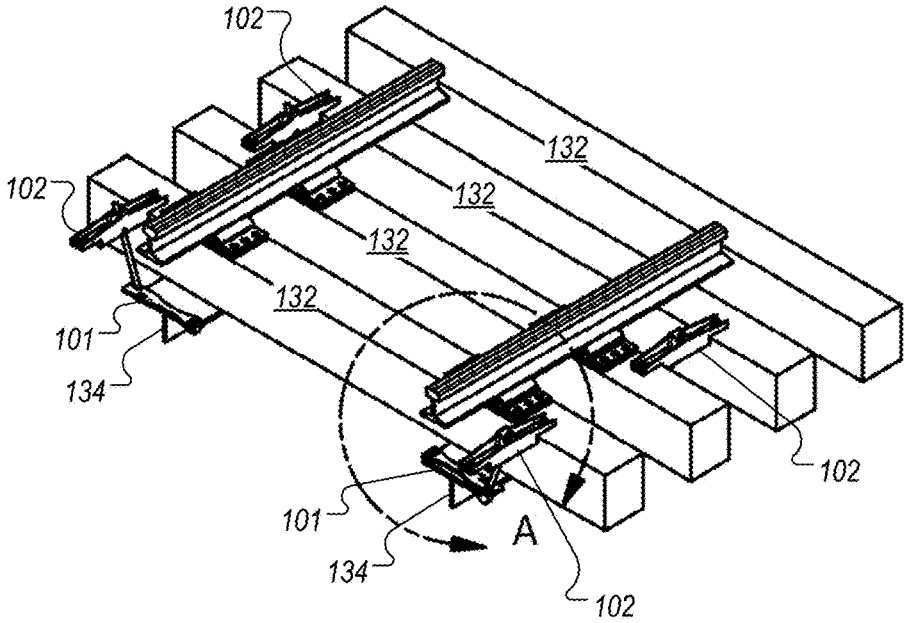
FIG. 2B shows multiple tie brackets being used on adjacent bridge ties on a bridge beam.

FIG. 2B shows multiple tie brackets 102 and cross straps 101 being used on adjacent bridge timbers 132 on a bridge beam 134. In some embodiments (and shown in this example), multiple tie brackets 102 can serve to replace a guard timber used on some bridges. For example, tie brackets 102 can be made in variations (e.g., taller) for enlarged bearing surface when being used in combination to replace (and function as) a guard timber. Lengths of tie bracket 102 can vary so that multiple tie brackets 102 can be butted end-to-end in series and be used for different spacing of adjacent bridge ties.

Figure 2C:
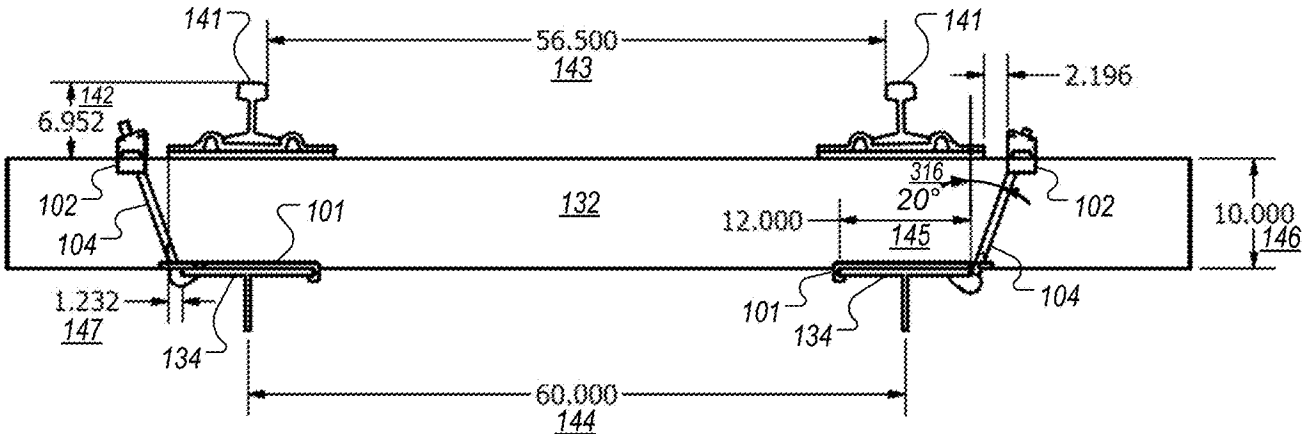
FIG. 2C is a front view of the configuration of the multiple tie brackets shown in FIG. 2B.

FIG. 2C is a front view of the configuration of the multiple tie brackets 102 and cross straps 101 shown in FIG. 2B. For example, the view shown in FIG. 2C is looking parallel to and down the length of the bridge beam 134 at a lateral side of a bridge timber 132. A top of a rail 141 can be, for example, a distance 142 (e.g., 6.952 inches) above a top of the bridge timber 132. A distance 143 between inner edges of the rails 141 can be 56.5 inches. A distance 144 between centers of bridge beams 144 can be 60.0 inches. Top flanges of the bridge beam 134 can have a width 145 of 12 inches, although having multiple slot 182 in the cross strap 101 can enable installations on bridge beams 134 having other widths 145. A height 146 of the bridge timber 132 can be 10.0 inches. A thickness 147 of the cross strap 101 at the bridge beam 134 can be 1.232 inches. Other dimensions, sizes and distances are possible.

Figure 2E:
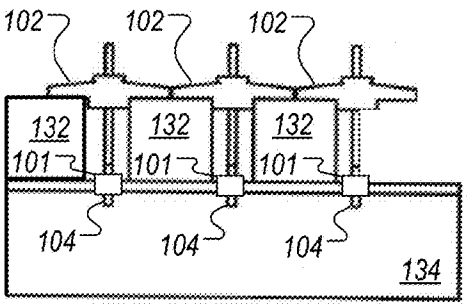
FIG. 2E is an opposite side view of the multiple tie brackets shown in FIG. 2D.
Figure 2D:
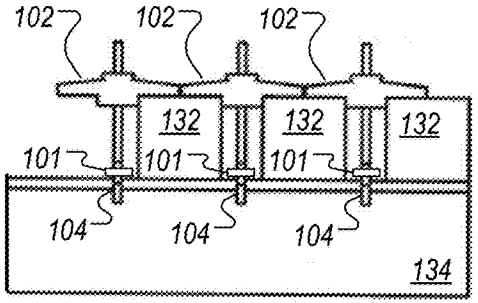
FIG. 2D is a side view of the configuration of the multiple tie brackets shown in FIG. 2B.

FIG. 2D is a side view of the configuration of the multiple tie brackets 102 and cross straps 101 shown in FIG. 2B. For example, the view shown in FIG. 2D is perpendicular to the side of the bridge beam 134 (e.g., looking from the side of the bridge). In this view, the slot ends 185 of the cross straps 101 are shown.

FIG. 2E is an opposite side view of the multiple tie brackets 102 shown in FIG. 2D. In this view, the hook ends 183 of the cross straps 101 are shown.

Figure 3A:
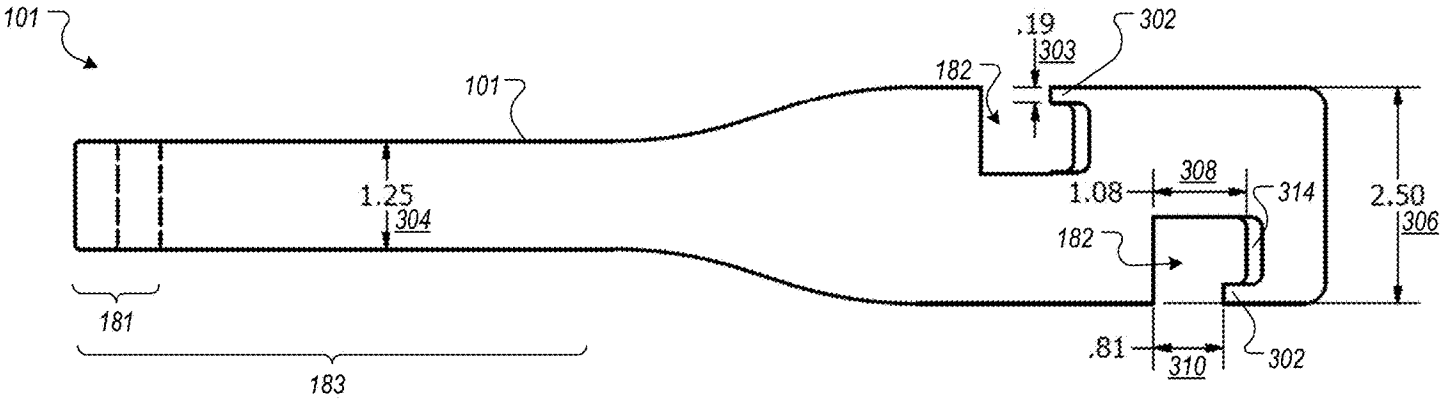
FIG. 3A is a top view of the cross strap.
Figure 3B:
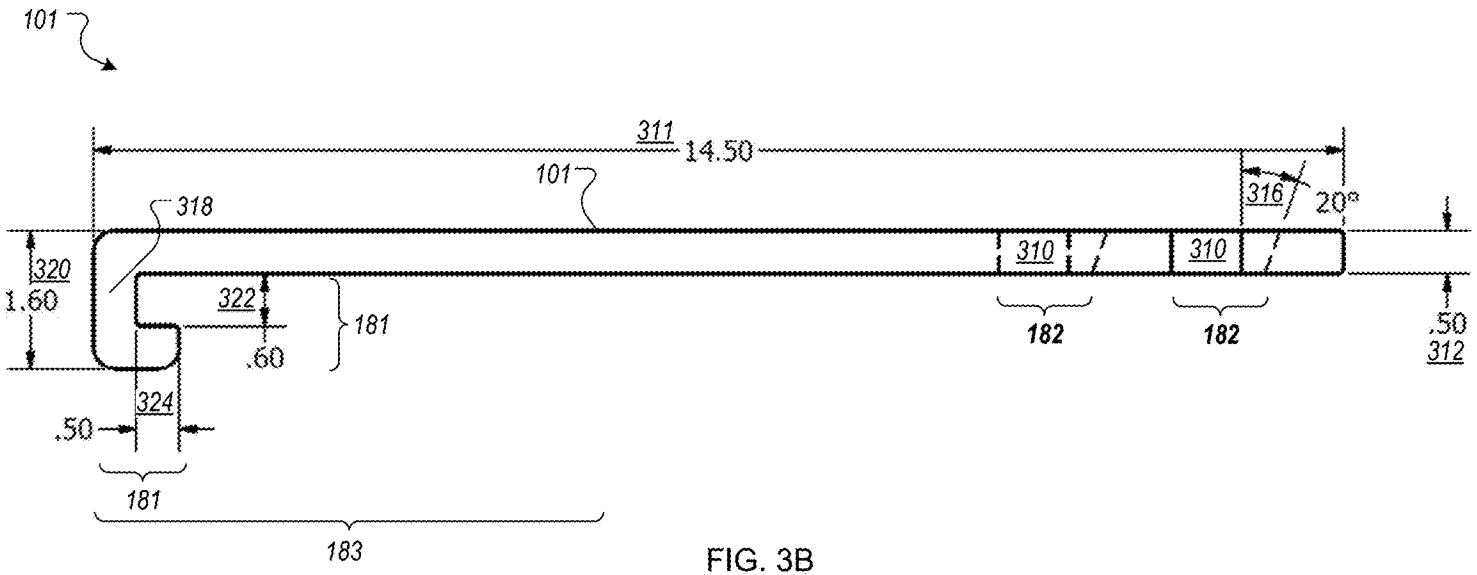
FIG. 3B is a side view of the cross strap.

FIG. 3A is a top view of the cross strap 101. FIG. 3B is a side view of the cross strap 101. These views show the slots 182, either one of which can be used during installation of the hook bolt 104. For example, the slot 182 that is used during installation of the cross strap 101 depends on the size of the beam, specifically the width of the flange, on which the cross strap 101 is installed. Some embodiments of the cross strap 101 can include a single slot 182, or additional slots 182 can exist that are compatible with different flange sizes and installation configurations. The cross strap 101 can include, at each of the slots 182, a protrusion 302, (e.g., with a width 303 of 0.19 inches) that serves to contain the hook bolt 104 in the slot 182 during installation. In some implementations, the cross strap 101 can have a width 304 of 1.25 inches at the hook end 183, and a width 306 of 2.5 inches at the slot end 185. In some implementations, the width 304 can be greater than 1.25 inches, e.g., to provide greater strength where the cross strap 101 hooks over the flange. Each slot 182 can have an opening length 308 of 1.08 inches, which is larger than the diameter of the hook bolt 104 that is to pass through an opening 310 (e.g., 0.81 inches) at a side of the slot 182 during installation. The cross strap 101 can have a length 311 of 14.0 inches and a thickness 312 of 0.5 inches. The cross strap 101 includes, within the slot 182, a recess with a sloped edge 314 that is sloped at an angle 316 (e.g., 20 degrees) substantially matching an angle of installation of the hook bolt 104. It is against the sloped edge 314 that the hook bolt 104, when installed, applies a lateral force to the cross strap 101 that causes the cross strap 101 to be securely engaged with the flange. The lateral force also causes the hook bolt 104 to be engaged with both of the cross strap 101 and the flange, e.g., forcing and securing the hook of the hook bolt 104 under the flange. A hook 318 of the cross strap 101 at the hook end 183 can have a height 320 of 1.6 inches and an opening 322, e.g., of 0.6 inches, for receiving the flange. A hook overlap 324 of 0.5 inches can overlap the flange along an underside of the flange. Other dimensions and angles are possible.

Figure 3C:
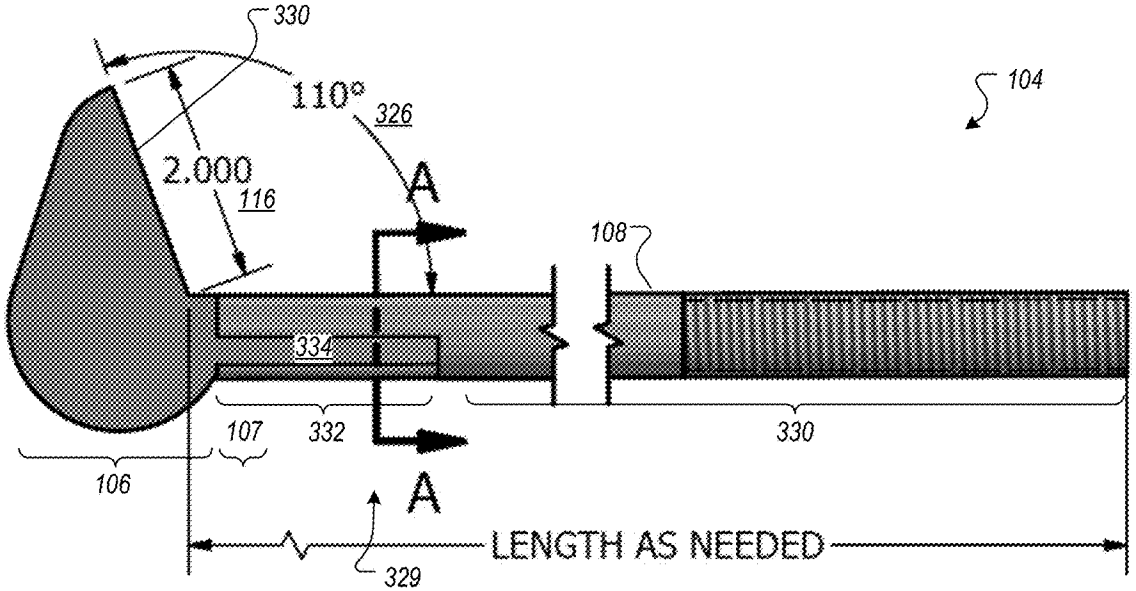
FIG. 3C is a side view of the hook bolt.
Figure 3D:
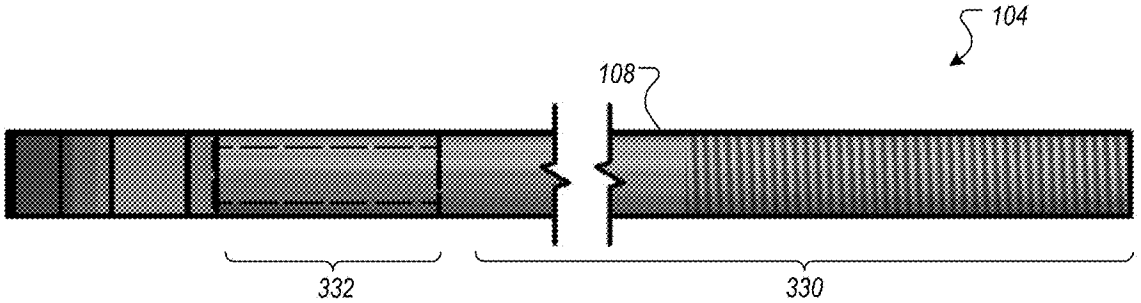
FIG. 3D is a top view of the hook bolt.
Figure 3E:
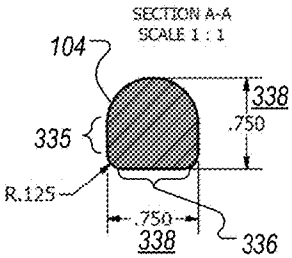
FIG. 3E is an end view of the hook bolt.

FIG. 3C is a side view of the hook bolt 104. FIG. 3D is a top view of the hook bolt 104. FIG. 3E is an end view of the hook bolt 104, showing a cross section of the hook bolt 104 at a location 329. These views show the hook 106 of the hook bolt 104 that includes a flat edge 330 for engaging with the flange upon installation. As shown, the flat edge 330 is at an angle 326 exceeding 90 degrees (e.g., 110 degrees) relative to the shank of the hook bolt 104. As shown in the side view, a relative flat side of the hook 106 can extend to a lower section 332 of the hook bolt 104, the lower section 332 having a cross-sectional shape (e.g., at location 329) of a circle nearest the flat edge 330, and including flat sides 335, rounded corners, and a flat edge 336 for engaging the sloped edge 314 of the cross strap 101. A cross section of a threaded upper section 334 of the hook bolt 104 can be substantially round, especially at the threaded end. A thickness 338 (e.g., both height and width) of the hook bolt can be, for example, 0.75 inches.

Figure 3F:
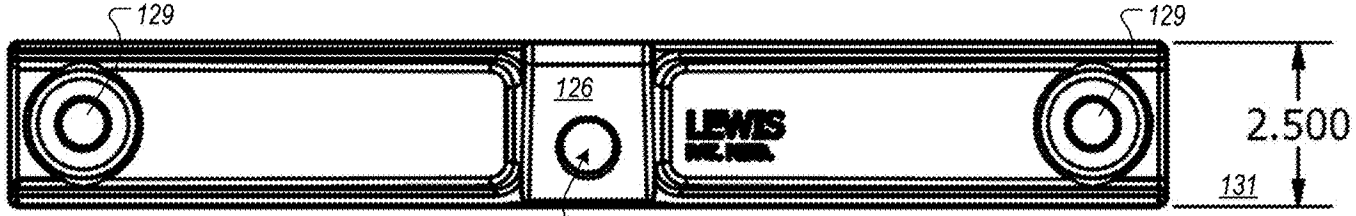
FIG. 3F is a top view of the tie bracket.
Figure 3H:
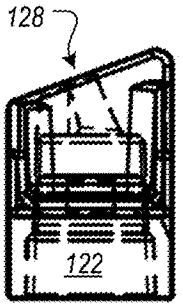
FIG. 3H is an end view of the tie bracket.
Figure 3G:
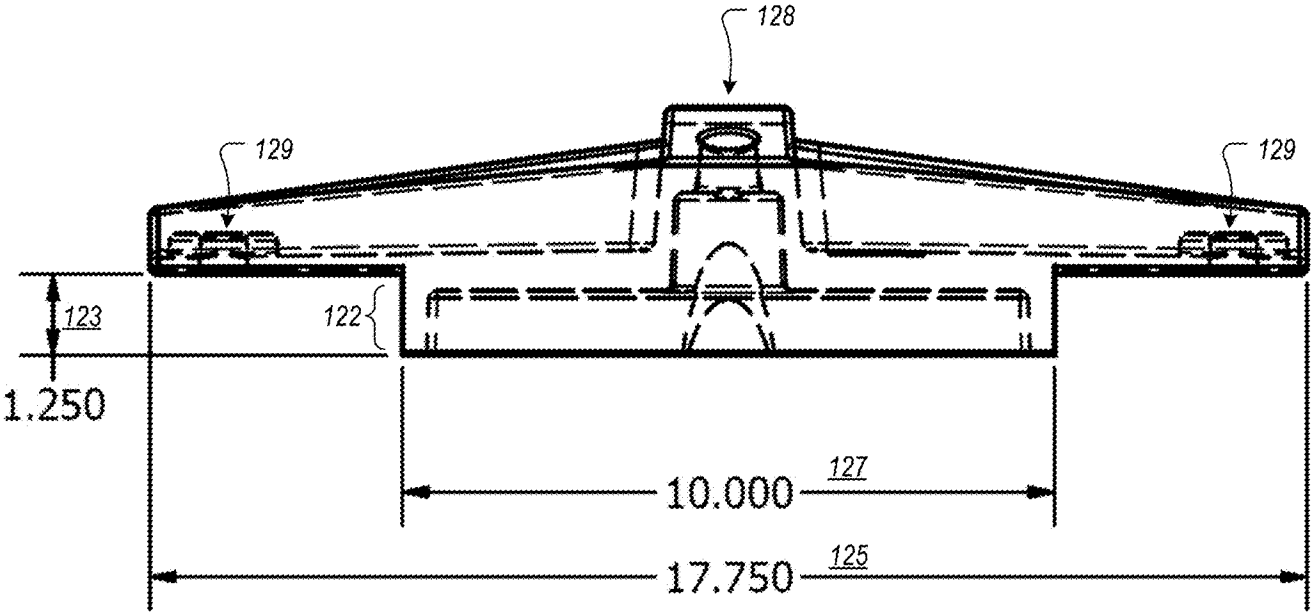
FIG. 3G is a side view of the tie bracket.
Figure 4A:
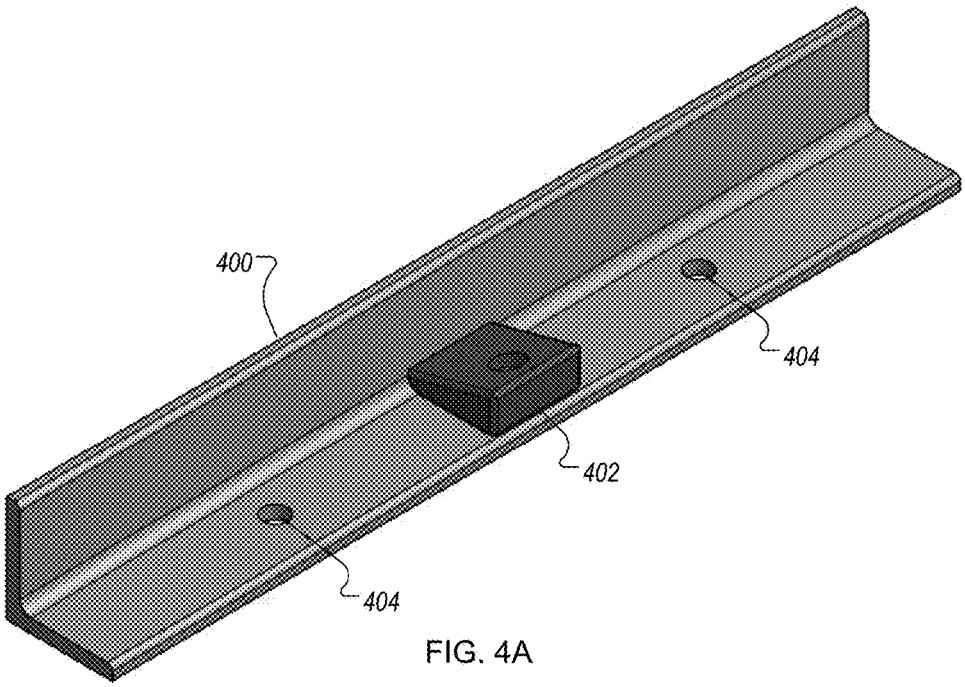
FIGS. 4A and 4B are perspective views of an L-shaped structural steel bar.
Figure 4B:
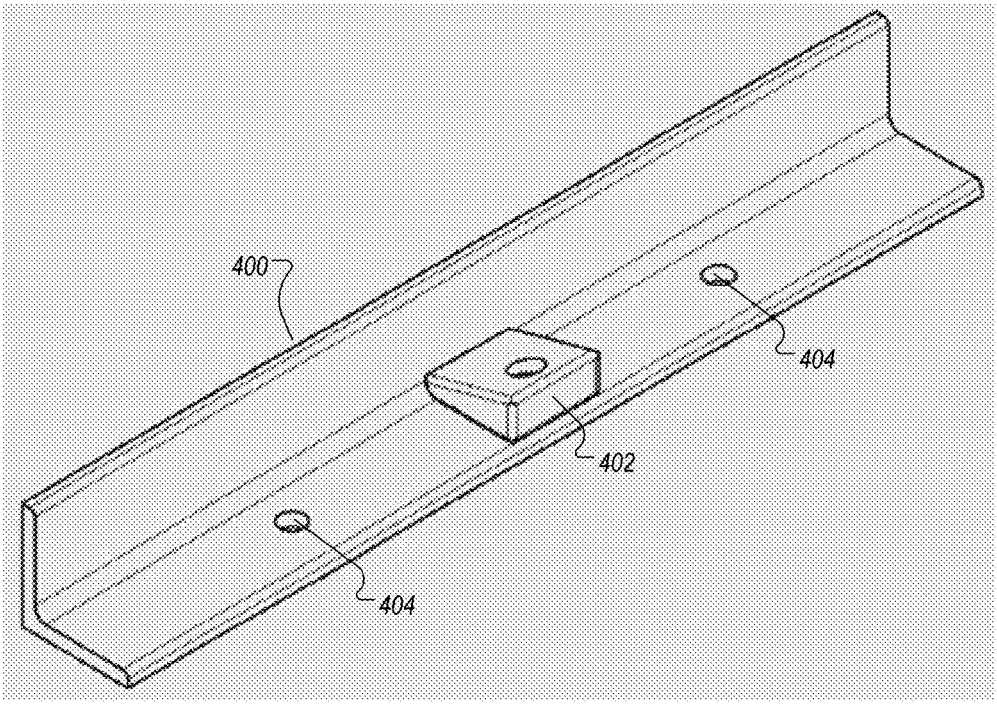

FIG. 3F is a top view of the tie bracket 102. FIG. 3G is a side view of the tie bracket 102. FIG. 3H is an end view of the tie bracket 102. These views show a protrusion 122 from the bottom of the tie bracket 102, e.g., having a depth 123 of 1.235 inches. This view also shows the flat upper surface 126, the bolt hole 128, and the bosses 129 along the top of the tie bracket 102. The tie bracket 102 can have a length 125 of 17.75 inches, and the protrusion 122 can have a length 127 of 10.0 inches. The tie bracket 102 can have a width 131 of 2.5 inches. FIGS. 4A and 4B are perspective views of an L-shaped structural steel bar 400. In some implementations, the L-shaped structural steel bar 400 can replace the tie bracket 102 as a metal member for engaging two or more ties (e.g., bridge ties). For example, the metal member can be the L-shaped structural steel bar having plural bolt holes 404. Each respective bolt hole 404 can receive a respective threaded hook bolt (e.g., the hook bolt 104). Each respective threaded hook bolt can be operable to engage with a cross strap 101 and the superstructure. Other shapes and configurations of bars are possible, such as bars to be used instead of, or in addition to, the L-shaped structural steel bar 400. L-shaped structural steel bars 400 can be manufactured in different sizes, different lengths, and with or without holes pre-drilled for ease of installation. Each L-shaped structural steel bar 400 can be sized to engage two or more ties.

In some implementations, including implementations using the L-shaped structural steel bar 400, for example, the system 100 can include an angled washer 402. The angled washer 402 can be operable for installation on a respective threaded hook bolt (e.g., the hook bolt 104) between the nut and the L-shaped structural steel bar. An angle of the angled washer can be operable to accept a perpendicular installation of the threaded end of the respective threaded hook bolt. The shape and size of the angled washer can be operable to stay in position during installation. For example, the shape, size, and position of installation of angled washers 402 can be determined such that a substantially straight side of the angled washer 402 engages with a side wall of the L-shaped structural steel bar 400 to prevent turning of the washer during installation.

Figure 5:
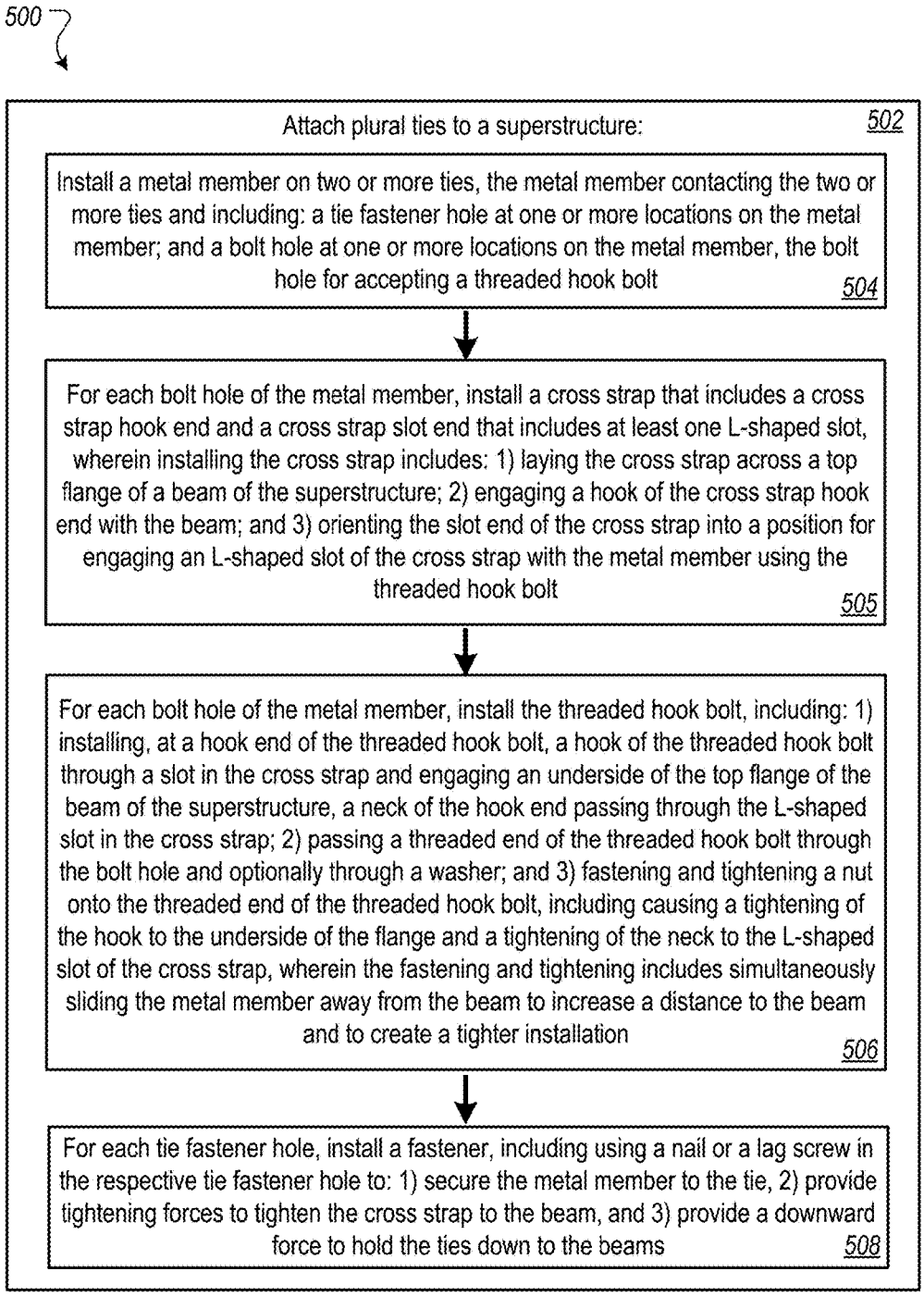
FIG. 5 is a flow diagram of an example process for installing plural ties on a superstructure.

FIG. 5 is a flow diagram of an example process 500 for installing plural ties on a superstructure. For example, the process 500 can be used to install bridge ties on a railroad bridge superstructure, as described above. FIGS. 1A-4B and the corresponding descriptions provide example structures for performing the process 500. Other structures can be used.

At 502, plural ties are attached to a superstructure, including the following steps 504-508. Attaching the plural ties to the superstructure can occur from above the superstructure without drilling holes in the ties or the superstructure and without requiring manned installation from below the superstructure.

At 504, a metal member is installed on two or more ties. The metal member contacts (e.g., is positioned atop) the two or more ties and includes a tie fastener hole at one or more locations (e.g., at holes below the bosses 129) on the metal member and a bolt hole (e.g., the bolt hole 128) at one or more locations on the metal member. The bolt hole is for accepting a threaded hook bolt (e.g., the hook bolt 104). The metal member, for example, can be the tie bracket 102 or the L-shaped structural steel bar 400, described above.

At 505, for each bolt hole of the metal member, a cross strap 101 is installed. The cross strap 101 includes a cross strap hook end and a cross strap slot end that includes at least one L-shaped slot (e.g., the slot 182). Installing the cross strap 101 includes laying the cross strap 101 across a top flange of a beam of the superstructure, such as laying the cross strap 101 substantially perpendicular to the length of the beam. Installing the cross strap 101 further includes engaging a hook (e.g., the hook 318) of the cross strap hook end with the beam, such as pulling the hook 318 over the edge of the beam. Installing the cross strap 101 further includes orienting the slot end of the cross strap 101 into a position for engaging an L-shaped slot (e.g., the 182) of the cross strap 101 with the metal member using the threaded hook bolt, for example placing the cross strap slot end in a position in which engagement can occur with the tie bracket 102.

At 506, for each bolt hole of the metal member, the threaded hook bolt (e.g., the hook bolt 104) is installed. Installing the threaded hook bolt includes installing, at a hook end of the threaded hook bolt, a hook (e.g., the hook 106) of the threaded hook bolt through a slot (e.g., the 182) in the cross strap 101 and engaging an underside of the top flange of the beam of the superstructure, a neck (e.g., the neck 107) of the hook end passing through the L-shaped slot in the cross strap. Installing the threaded hook bolt further includes passing a threaded end (e.g., the threaded end 112) of the threaded hook bolt through the bolt hole and optionally through a washer. Installing the threaded hook bolt further includes fastening and tightening a nut onto the threaded end of the threaded hook bolt, including causing a tightening of the hook to the underside of the flange and a tightening of the neck to the L-shaped slot of the cross strap, wherein the fastening and tightening includes simultaneously sliding the metal member away from the beam to increase a distance to the beam and to create a tighter installation.

At 508, for each tie fastener hole, a fastener is installed, including using a nail or a lag screw in the respective tie fastener hole to secure the metal member to the tie. For example, installation can occur for the tie fastener holes in the tie bracket 102 or the L-shaped structural steel bar 400, described above.

In some implementations, the metal member can be a tie bracket (e.g., the tie bracket 102). The tie bracket can include a center section, including the tie fastener hole (e.g., the hole 128) for receiving the threaded hook bolt (e.g., the hook bolt 104). The center section is operable to engage with the threaded hook bolt for fastening to the superstructure.

The tie bracket can further include two bracket ends connected to the center section, each bracket end for engaging with respective ones of adjacent ties. Bottom sides of the bracket ends can be configured, when installed, to engage with upper edges of the respective ones of adjacent ties.

In some implementations, the metal member can be an L-shaped structural steel bar (e.g., the L-shaped structural steel bar 400) having plural bolt holes, each respective bolt hole for receiving a respective threaded hook bolt, each respective threaded hook bolt for engaging with the superstructure.

In some implementations, the method can further include installing an angled washer (e.g., the angled washer 402) at each of the plural bolt holes. The angled washer can be installed on a respective threaded hook bolt between the nut and the L-shaped structural steel bar. An angle of the angled washer can be operable to accept a perpendicular installation of the threaded end of the respective threaded hook bolt. The shape and size of the angled washer can be operable to stay in position during installation.

In some implementations, a shank of the threaded hook bolt (e.g., the hook bolt 104) can include a bend distal from the hook, the bend creating an angle in the threaded hook bolt, the angle being greater than 90° to the hook. The bend can be approximately 15 degrees.

In some implementations, the hook (e.g., the hook 106) can have an enlarged thickness at a bend in the hook, the enlarged thickness being relative to other portions of the hook.

In some implementations, the hook end (e.g., the hook end 116) can include a substantially flat surface having a length of approximately 2 inches and configured to engage the flange.

In some implementations, the threaded hook bolt (e.g., the hook bolt 104) can include threads having thread specifications of ¾ inch and 10 UNC, wherein the threads are configured to accept a nut of the same thread specifications.

In some implementations, the shank (e.g., of the hook bolt 104) can have an extended length, enabling installation of the hook to the flange when the threaded hook bolt is pre-positioned through the bolt hole and when the nut and the washer are pre-assembled to the threaded end of the threaded hook bolt.

In some implementations, each bracket end of the tie bracket (e.g., the tie bracket 102) can include a boss with a tie fastener hole that is vertical or at an angle relative to the tie bracket and is operable to accept a nail, a lag screw, or another fastener to secure the bracket end to a respective tie.

In some implementations, each bracket end of the tie bracket (e.g., the tie bracket 102) can include, along the bottom of the tie bracket, grooves configured to grip an upper edge of a respective tie and resist movement of the tie bracket relative to the respective tie.

In some implementations, the center section of the tie bracket (e.g., the tie bracket 102) can include a flat upper surface, wherein, when the threaded hook bolt is installed in the tie bracket, the flat upper surface is substantially perpendicular to the shank at the threaded end of the threaded hook bolt, and wherein the flat upper surface is configured to engage the nut and, optionally, the washer.

In some implementations, the center section of the tie bracket (e.g., the tie bracket 102) can include a protrusion that extends below bottom surfaces of the bracket ends of the tie bracket and below the top surfaces of adjacent ties, and is configured to position the tie bracket between, and for the protrusion to substantially fill a space between, adjacent ties.

In some implementations, the bracket ends of the tie bracket (e.g., the tie bracket 102) can include side walls extending upward from substantially flat portions of the bracket ends, the side walls providing increased strength of the bracket ends.

In some implementations, the superstructure can be a steel superstructure of a bridge.

The present disclosure describes some embodiments of the system 100. Other embodiments are possible.

What is claimed is:

1. A tie fastener apparatus for attaching railroad ties to a superstructure, the tie fastener apparatus comprising:

a threaded hook bolt, including a hook on one end of the threaded hook bolt, the hook including a hook end configured to engage the underside of a flange of a beam of the superstructure;

a cross strap that includes a cross strap hook end and a cross strap slot end, the cross strap hook end including a hook configured to engage a top flange of a beam of the superstructure, the cross strap slot end including one or more L-shaped slots for engaging the threaded hook bolt;

a metal member for engaging two or more ties, the metal member including a tie fastener hole at one or more locations; and a nut configured to be fastened to a threaded end of the threaded hook bolt for installation when the threaded hook bolt is passed through the bolt hole and optionally through a washer;

wherein, when the threaded hook bolt is installed, including passing the threaded end of the threaded hook bolt through the bolt hole and fastening with the nut:

a neck of the hook engages the slot of the cross strap; and the hook engages the superstructure and an L-shaped slot in the cross strap, tightening the cross strap to the underside of the flange of the beam; and wherein the tie fastener apparatus is configured to be installed from above the superstructure without drilling holes in the ties or the superstructure and without requiring manned installation from below the superstructure.

2. The tie fastener apparatus of claim 1, wherein the metal member is a tie bracket including:

a center section, including the tie fastener hole for receiving the threaded hook bolt, the center section operable to engage with the threaded hook bolt for fastening to the superstructure; and two bracket ends connected to the center section, each bracket end for engaging with respective ones of adjacent ties;

wherein bottom sides of the bracket ends are configured, when installed, to engage with upper edges of the respective ones of adjacent ties.

3. The tie fastener apparatus of claim 1, wherein the metal member is an L-shaped structural steel bar having plural bolt holes, each respective bolt hole for receiving a respective threaded hook bolt, each respective threaded hook bolt for engaging with the superstructure.

4. The tie fastener apparatus of claim 3, further comprising an angled washer operable for installation on a respective threaded hook bolt between the nut and the L-shaped structural steel bar, an angle of the angled washer operable to accept a perpendicular installation of the threaded end of the respective threaded hook bolt, the shape and size of the angled washer operable to stay in position during installation, and wherein a shank of the threaded hook bolt includes a bend distal from the hook, the bend creating an angle in the threaded hook bolt, the angle being greater than 90° to the hook.

5. The tie fastener apparatus of claim 1, wherein a shank of the threaded hook bolt includes a bend distal from the hook, the bend creating an angle in the threaded hook bolt, the angle being greater than 90° to the hook.

6. The tie fastener apparatus of claim 1, wherein the shank has an extended length, enabling installation of the hook to the flange when the threaded hook bolt is pre-positioned through the bolt hole and when the nut and the washer are pre-assembled to the threaded end of the threaded hook bolt.

7. The tie fastener apparatus of claim 2, wherein each bracket end of the tie bracket includes a boss with a tie fastener hole that is vertical or at an angle relative to the tie bracket and is operable to accept a nail, a lag screw, or another fastener to secure the bracket end to a respective tie.

8. The tie fastener apparatus of claim 2, wherein each bracket end of the tie bracket includes, along the bottom of the tie bracket, grooves configured to grip an upper edge of a respective tie and resist movement of the tie bracket relative to the respective tie.

9. The tie fastener apparatus of claim 2, wherein the center section of the tie bracket includes a flat upper surface, wherein, when the threaded hook bolt is installed in the tie bracket, the flat upper surface is substantially perpendicular to the shank at the threaded end of the threaded hook bolt, and wherein the flat upper surface is configured to engage the nut and, optionally, the washer.

10. The tie fastener apparatus of claim 2, wherein the center section of the tie bracket includes a protrusion that extends below bottom surfaces of the bracket ends of the tie bracket and below the top surfaces of adjacent ties, and is configured to position the tie bracket between, and for the protrusion to substantially fill a space between, adjacent ties.

11. The tie fastener apparatus of claim 2, wherein the bracket ends of the tie bracket include side walls extending upward from substantially flat portions of the bracket ends, the side walls providing increased strength of the bracket ends.

12. The tie fastener apparatus of claim 1, wherein the metal member is a reinforced L-shaped structural steel bar comprising:

plural bolt holes, each respective bolt hole for receiving a respective threaded hook bolt for engaging with the superstructure, each threaded hook bolt engaged with the reinforced L-shaped structural steel bar using a nut and optionally a washer; and plural tie fastener holes, each respective tie fastener hole for accepting a fastener for fastening to a respective tie, each tie fastener hole operable to accept a nail, a lag screw, or another fastener to secure the reinforced L-shaped structural steel bar to a respective tie.

13. The tie fastener apparatus of claim 12, further comprising a boss at each of the plural bolt holes, the top surface of the boss angled relative to the respective bolt hole so that the threaded end of the threaded hook bolt is perpendicular to the top surface of the boss.

14. The tie fastener apparatus of claim 12, further comprising a tab end and a tab-ready end, the tab end configured to fit into the tab-ready end during installation.

15. The tie fastener apparatus of claim 12, further comprising stabilizers that connect, and provide structural stabilizing strength to, a bottom portion of the reinforced L-shaped structural steel bar and a side of the reinforced L-shaped structural steel bar.

16. The tie fastener apparatus of claim 1, wherein the cross strap is a formed piece that is cast of steel or other suitable material.

17. A method comprising:

attaching plural ties to a superstructure, including:

installing a metal member on two or more ties, the metal member contacting the two or more ties and including:

a tie fastener hole at one or more locations on the metal member; and a bolt hole at one or more locations on the metal member, the bolt hole for accepting a threaded hook bolt;

for each bolt hole of the metal member, installing a cross strap that includes a cross strap hook end and a cross strap slot end that includes at least one L-shaped slot, wherein installing the cross strap includes:

laying the cross strap across a top flange of a beam of the superstructure;

engaging a hook of the cross strap hook end with the beam; and orienting the slot end of the cross strap into a position for engaging an L-shaped slot of the cross strap with the metal member using the threaded hook bolt for each bolt hole of the metal member, installing the threaded hook bolt, including:

installing, at a hook end of the threaded hook bolt, a hook of the threaded hook bolt through a slot in the cross strap and engaging an underside of the top flange of the beam of the superstructure, a neck of the hook end passing through the L-shaped slot in the cross strap;

passing a threaded end of the threaded hook bolt through the bolt hole and optionally through a washer; and fastening and tightening a nut onto the threaded end of the threaded hook bolt, including causing a tightening of the hook to the underside of the flange and a tightening of the neck to the L-shaped slot of the cross strap, wherein the fastening and tightening includes simultaneously sliding the metal member away from the beam to increase a distance to the beam and to create a tighter installation; and for each tie fastener hole, installing a fastener, including using a nail or a lag screw in the respective tie fastener hole to secure the metal member to the tie;

wherein attaching the plural ties to the superstructure occurs from above the superstructure without drilling holes in the ties or the superstructure and without requiring manned installation from below the superstructure.

18. The method of claim 17, wherein the metal member is a tie bracket including:

a center section, including the tie fastener hole for receiving the threaded hook bolt, the center section operable to engage with the threaded hook bolt for fastening to the superstructure; and two bracket ends connected to the center section, each bracket end for engaging with respective ones of adjacent ties;

wherein bottom sides of the bracket ends are configured, when installed, to engage with upper edges of the respective ones of adjacent ties.

19. The method of claim 17, wherein the metal member is an L-shaped structural steel bar having plural bolt holes, each respective bolt hole for receiving a respective threaded hook bolt, each respective threaded hook bolt for engaging with the superstructure.

20. The method of claim 19, further comprising installing an angled washer at each of the plural bolt holes, the angled washer installed on a respective threaded hook bolt between the nut and the L-shaped structural steel bar, an angle of the angled washer operable to accept a perpendicular installation of the threaded end of the respective threaded hook bolt, the shape and size of the angled washer operable to stay in position during installation, and wherein a shank of the threaded hook bolt includes a bend distal from the hook, the bend creating an angle in the threaded hook bolt, the angle being greater than 90° to the hook.

21. The method of claim 18, wherein each bracket end of the tie bracket includes a boss with a tie fastener hole that is vertical or at an angle relative to the tie bracket and is operable to accept a nail, a lag screw, or another fastener to secure the bracket end to a respective tie.

22. The method of claim 18, wherein each bracket end of the tie bracket includes, along the bottom of the tie bracket, grooves configured to grip an upper edge of a respective tie and resist movement of the tie bracket relative to the respective tie.

* * * * *